US005433156A

United States Patent [19]

Hutchison

[11] Patent Number: 5,433,156

[45] Date of Patent: Jul. 18, 1995

[54] CONSTRUCTION OF PALLETS FROM CORRUGATED SHEET MATERIAL

[75] Inventor: Joel P. Hutchison, San Antonio, Tex.

[73] Assignee: Miriam M. Benson, San Antonio, Tex.

[21] Appl. No.: 178,835

[22] Filed: Jan. 7, 1994

[51] Int. Cl.[6] ..... B65D 19/00

[52] U.S. Cl. ..... 108/51.3; 428/184; 428/186; 108/56.1

[58] Field of Search ..... 108/51.3, 51.1, 56.1, 108/56.3; 428/184, 185, 186

[56] References Cited

U.S. PATENT DOCUMENTS

| | | | |
|---|---|---|---|
| 1,955,833 | 4/1934 | Romanoff | 428/186 X |
| 2,045,733 | 6/1936 | Spafford . | |
| 2,503,022 | 4/1950 | Benoist et al. | 108/51.1 |
| 3,006,590 | 10/1961 | Hoag . | |
| 3,092,046 | 6/1963 | Davidson | 108/56.1 X |
| 3,096,224 | 7/1963 | Goldstein et al. | 428/186 |
| 3,407,758 | 10/1968 | Simkins | 108/51.3 |
| 3,464,371 | 9/1969 | Gifford . | |
| 3,542,636 | 11/1970 | Wandel | 428/185 X |
| 3,661,099 | 5/1972 | Shelor . | |
| 3,861,326 | 1/1975 | Brown | 108/51.1 |
| 4,044,981 | 8/1977 | Richter . | |
| 4,378,743 | 4/1983 | McFarland . | |
| 4,424,753 | 1/1984 | Eatherton . | |
| 4,647,063 | 3/1987 | Piringer et al. . | |
| 4,714,026 | 12/1987 | Yamaguchi et al. . | |
| 4,863,024 | 9/1989 | Booth . | |
| 4,950,524 | 8/1990 | Hacker | 428/184 |
| 4,979,446 | 12/1990 | Winebarger . | |
| 5,042,397 | 8/1991 | Fiedler . | |
| 5,052,307 | 10/1991 | Morrison | 108/56.1 X |
| 5,057,176 | 10/1991 | Bainbridge . | |
| 5,076,176 | 12/1991 | Clasen . | |
| 5,156,094 | 10/1992 | Johansson et al. . | |
| 5,226,544 | 7/1993 | Gallucci et al. . | |

FOREIGN PATENT DOCUMENTS

| | | | |
|---|---|---|---|
| 83762 | 10/1957 | Denmark | 428/185 |
| 2458260 | 6/1976 | Germany | 428/184 |
| 4314504 | 12/1993 | Germany | 108/51.3 |
| 558741 | 2/1975 | Switzerland . | |
| 2173768 | 10/1986 | United Kingdom . | |

*Primary Examiner*—José V. Chen
*Assistant Examiner*—Janet M. Wilkens
*Attorney, Agent, or Firm*—Richard C. Litman

[57] ABSTRACT

A shipping pallet is constructed of multiple laminations of corrugated sheet material, with specific construction details providing advantages in strength and trueness of the completed pallet, and further advantages in the reduction of tooling and labor costs. The stringers or runners, deck boards, and top and (optional) bottom sheets may be sawn from stacks of plural laminations, thus precluding any requirement for costly dies and intensive labor. Asymmetrical corrugated sheets may be used, with one side having a different weight than the other. By laminating two such sheets together with like weighted sides in contact, the tendency of such sheets to curve or warp due to the difference in side thickness is substantially eliminated. Different orientations of the corrugations or flutes of the sheets during lamination and assembly of the pallet, provide advantages in strength for specific applications. One flute configuration substantially reduces the dust otherwise produced during the cutting operation, thus simplifying the manufacture of the pallet and reducing dust emanations from the pallet when in use. The pallet may be constructed of plural laminations of various corrugated sheet materials, such as paperboard or fiberboard, or plastic.

19 Claims, 7 Drawing Sheets

CONSTRUCTION OF PALLETS FROM CORRUGATED SHEET MATERIAL

FIELD OF THE INVENTION

The present invention relates generally to shipping pallets used in the shipping industry, and more specifically to pallet construction using corrugated cardboard, paperboard, plastic and/or other corrugated materials. Specific orientation of the corrugations or flutes of the material, and in laminating the corrugated sheets, provide advantages in the manufacture and use of the pallets.

BACKGROUND OF THE INVENTION

Traditionally, shipping pallets have been constructed of wood slats and/or runners or stringers of various dimensions. Such wood pallets are relatively costly, even though they are generally cheaply made of relatively poor quality wood. The hasty assembly and poor wood quality result in pallets which may rapidly become damaged to the point of being unusable. Moreover, such pallets are relatively heavy, resulting in additional shipping costs to the shipper, just for the weight and volume of the pallets themselves.

As a result, pallets formed of other materials have been developed, and in fact pallets constructed of corrugated cardboard have been known since the early '60's, if not earlier. However, the various pallets formed of corrugated materials have been deficient in areas of strength, durability, warping, and/or environmental concerns (e.g., dust produced during manufacture, and/or difficulty in recycling), compared to the present invention.

The need arises for pallets constructed of corrugated sheet material, which provide for specific orientation of the corrugations and laminations to provide additional strength, freedom from warping, and for the reduction of dust during manufacture and use. The materials used are preferably recyclable in order to provide further environmental advantages.

DESCRIPTION OF THE PRIOR ART

U.S. Pat. No. 2,045,733 issued to Allen L. Spafford on Jun. 30, 1936 discloses an Insulation Structure utilizing multiple sheets of corrugated material. Only FIG. 1 discloses the use of plural corrugated sheets, each of which includes opposite backing layers, and no disclosure is made of securing the layers together except at their peripheries. This construction lacks the structural strength required for use in pallet construction.

U.S. Pat. No. 3,006,590 issued to Lowell E. Hoag on Oct. 31, 1961 discloses a Corrugated Pallet generally formed of a single sheet of material, rather than the multiple laminations of the present invention. The resting pads or feet of the pallet are hollow, unless an additional step is taken to fill them with additional material for additional strength. The sheet requires a relatively costly die to make the required cuts, as well as a folding machine, rather than enabling construction by sawing multiple sheets, as can be done with the present construction.

U.S. Pat. No. 3,464,371 issued to Sheldon R. Gifford on Sep. 2, 1969 discloses a Disposable Pallet having folded upper and lower sheets and runners. The runners include filler material for additional strength. However, the folding of the structure requires additional costly equipment, unlike the present pallet.

U.S. Pat. No. 3,661,099 issued to Clifford D. Shelor on May 9, 1972 discloses a Pallet Deck having an upper and/or lower deck each formed of vertically oriented corrugations with top and bottom corrugated sheet overlays bonded thereto. Wood blocks are used for the pads or spacers between upper and lower sheets, thus resulting in a heavier pallet than otherwise. The wood blocks are nailed to the upper and lower sheets. The localized stress of a nail or screw at the cardboard sheet, would appear to cause premature damage to the structure when the nails are torn out. Moreover, the different materials and hand labor required to nail the blocks in place, would result in a more labor intensive pallet construction than the present pallet construction.

U.S. Pat. No. 4,044,981 issued to Robert H. Richter on Aug. 30, 1977 discloses a Paperboard Pallet formed of a plurality of folded corrugated sheets. The folds are upwardly disposed to provide for the securing of an article thereto, resulting in a non-planar upper surface. Due to the relatively thin nature of the overall structure, the laminations are oriented only horizontally, rather than providing other orientations for additional strength.

U.S. Pat. No. 4,378,743 issued to William M. McFarland on Apr. 5, 1983 discloses a Paperboard Pallet Having Interlocked Runners. The pallet sheet is formed of a single layer of material, folded up at the edges, with cutouts providing for the insertion of support pads or feet therethrough. The pads are secured to overlying runners, with pads and runners being formed of a solid material (wood, rubber, plastic) rather than having internal corrugations. The formation of the runners and pads, as well as the folding of the pallet sheet, result in the need for costly equipment or labor for the construction of the McFarland pallet.

U.S. Pat. No. 4,424,753 issued to John R. Eatherton on Jan. 10, 1984 discloses a Pallet Of Composite Construction having top and bottom sheets and runners of corrugated paperboard, but also including "stringers" (i.e., deck boards immediately beneath the top sheet) of wood. The different materials result in additional labor and/or equipment costs for production, as well as resulting in a relatively heavy pallet.

U.S. Pat. No. 4,647,063 issued to Robert Piringer et al. on Mar. 3, 1987 discloses a Lightweight Core For Laminate Constructions. Plural corrugated sheets laminated either flat, folded or rolled are disclosed. The corrugated sheet used in the laminations includes a backing on only one side, which is desirable for flexibility, according to the disclosure. The present invention requires greater strength and rigidity, and hence utilizes corrugated material having opposite backing sheets to each side of the corrugated core.

U.S. Pat. No. 4,714,026 issued to Akio Yamaguchi et al. on Dec. 22, 1987 discloses a Pallet For Material Handling having upper and/or lower sheets (described as deck boards) formed of corrugated material, with folded rectangular tubular runners or stringers therebeneath. Another embodiment utilizes a plurality of rectangular pads set in specially cut upper and lower sheets. The pads and stringer each include plastic inserts for greater strength. The numerous folds and different materials result in a pallet construction requiring relatively costly equipment and/or labor, unlike the single type of material used in the construction of a pallet of the present invention.

U.S. Pat. No. 4,863,024 issued to Clarence R. Booth on Sep. 5, 1989 discloses a Collapsible Pallet And Related Products. Again, special dies and folds must be used for the formation of the pallet, and the pallet also includes a plurality of wood deck boards, resulting in more complex construction than that required for the present invention.

U.S. Pat. No. 4,979,446 issued to Ken N. Winebarger on Dec. 25, 1993 discloses a Corrugated Pallet formed of a plurality of folded and die cut corrugated sheets. The cutouts or punchouts of the folded sheets form slots providing for the interlocking of the components to form runners and stringers to support a single corrugated top sheet. Again, the required dies and folding machinery result in a complex and costly construction, compared to the present invention.

U.S. Pat. No. 5,042,397 issued to Leslie C. Fiedler on Aug. 27, 1991 discloses Pallet Construction using corrugated sheets filled with a plastic material for greater strength. The pallet is otherwise conventional in construction, with the multiple filled corrugated laminates having similar properties to wood, both during manufacture and in use. The construction results in additional costs for the resins or plastics used in the manufacture of the pallet. In addition, glass fiber reinforcement is also disclosed for additional strength.

U.S. Pat. No. 5,057,176 issued to William Bainbridge on Oct. 15, 1991 discloses a Method Of Forming Corrugated paperboard Automotive Liner. The method bonds additional vapor barrier and sound dampening sheets to the corrugated layup, which has only a single ply between two corrugations. The present pallet provides for additional laminations using only corrugated sheet.

U.S. Pat. No. 5,076,176 issued to Hank A. Clasen on Dec. 31, 1991 discloses a Corrugated Cardboard Pallet formed of plural layers of corrugated cardboard. The construction is relatively complex, comprising base slats, spacer blocks, intermediate slats, and top slats, in addition to top and bottom sheets. The present invention provides stringers each formed as a single unit, to take the place of several of the Clasen pallet components and thereby simplify manufacture and provide a stronger pallet with fewer joints. Moreover, while Clasen states that his provided corrugation orientation is optimal, this will only be true for a relatively narrow range of desired pallet applications. (The intermediate slat 24 of FIG. 3 of Clasen is particularly confusing, as it shows the ends of the corrugations or flutes of the laminations in two different planes.) The present invention provides alternative orientations of the corrugated sheets used in the pallet laminations, for greater versatility. Also, it is noted that Clasen specifically provides only a single corrugated sheet for the top and (optional) bottom platform, relying upon the multitude of slats for lateral strength and support of a load. The present invention provides for multiple laminations of top and bottom sheets in one embodiment, for greater strength and protection against penetration. In addition to the above, the specific orientation of the present pallet corrugated sheets relative to top and bottom during the lamination, provides advantages in reducing or eliminating component warping, not foreseen by Clasen, and the orientation of the corrugations of some of the present structural components can greatly reduce the production of dust residue, which factor was not addressed by Clasen.

U.S. Pat. No. 5,156,094 issued to Bengt Johansson et al. on Oct. 20, 1992 discloses a Load-Carrying Pallet Of Corrugated Cardboard comprising one or more corrugated laminations forming an upper sheet, with plural pads or feet formed of multiple corrugated laminations secured thereto. As no intermediate structure is disclosed, each of the pads must be relatively low and wide, in order to reduce shear stresses. The present pallet is of a more conventional configuration, providing for more standardized utility, by means of its structure. The Johansson et al. pallet is relatively light and requires a wire or plastic matrix reinforcement of the pads, and is unsuitable for larger and/or heavier objects due to the relatively thin upper sheet.

U.S. Pat. No. 5,226,544 issued to Frank Gallucci et al. on Jul. 13, 1993 discloses a Reusable Pallet Wrapper. While the device relates to shipping pallets and is reusable, as are the prior art and present pallets at least to some extent, no further relationship is seen to the present invention.

British Patent No. 2,173,768 issued to Akio Yamaguchi et al. and published on Oct. 22, 1986 discloses a Pallet For Material Handling. The disclosure is essentially identical to that of U.S. Pat. No. 4,714,026 to the same inventors, discussed above.

Finally, Swiss Patent No. 558,741 to Philip J. Vecere and published on Feb. 17, 1975 discloses a Disposable Pallet Made From Cardboard Layers. The pallet has the same configuration as simpler wood pallets, but uses multiple corrugated laminations for the runners. The laminations are parallel to the upper sheet.

None of the above noted patents, taken either singly or in combination, are seen to disclose the specific arrangement of concepts disclosed by the present invention.

SUMMARY OF THE INVENTION

By the present invention, an improved construction of pallets from corrugated sheet material is disclosed.

Accordingly, one of the objects of the present invention is to provide an improved pallet of corrugated sheet which is of sturdy yet relatively simple construction and requires no special dies or folding machinery for its manufacture.

Another of the objects of the present invention is to provide an improved pallet which utilizes multiple laminations of corrugated sheet for the various structural components, with the corrugations or flutes of the sheets being oriented either parallel or perpendicular to one another and to those of other components, depending upon the structural requirements of the pallet.

Yet another of the objects of the present invention is to provide an improved pallet which utilizes asymmetrical corrugated sheets, with the sheets each having different weights of paper disposed to each side of the central corrugated flutes, and further to provide a lamination of such sheets which substantially reduces or eliminates any warping or curvature of such sheets due to their asymmetrical nature.

Still another of the objects of the present invention is to provide an improved pallet which provides a substantial reduction in paper dust during manufacture, and the reduction of such dust emanating from completed pallets, by means of the orientation of the corrugated laminates during cutting.

A further object of the present invention is to provide an improved pallet which provides an essentially standard configuration, thus providing substantial strength and durability in combination with the alternative materials used.

An additional object of the present invention is to provide an improved pallet which may be constructed of various corrugated materials, such as corrugated paperboard or cardboard, as well as corrugated plastic sheet material.

Another object of the present invention is to provide an improved pallet which in at least one embodiment, provides for pickup by a fork lift or the like from any of the four sides of the pallet.

Yet another object of the present invention is to provide an improved pallet which requires no mechanical fasteners for construction or assembly, but uses glues, adhesives and the like exclusively for construction and assembly.

A final object of the present invention is to provide an improved pallet for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
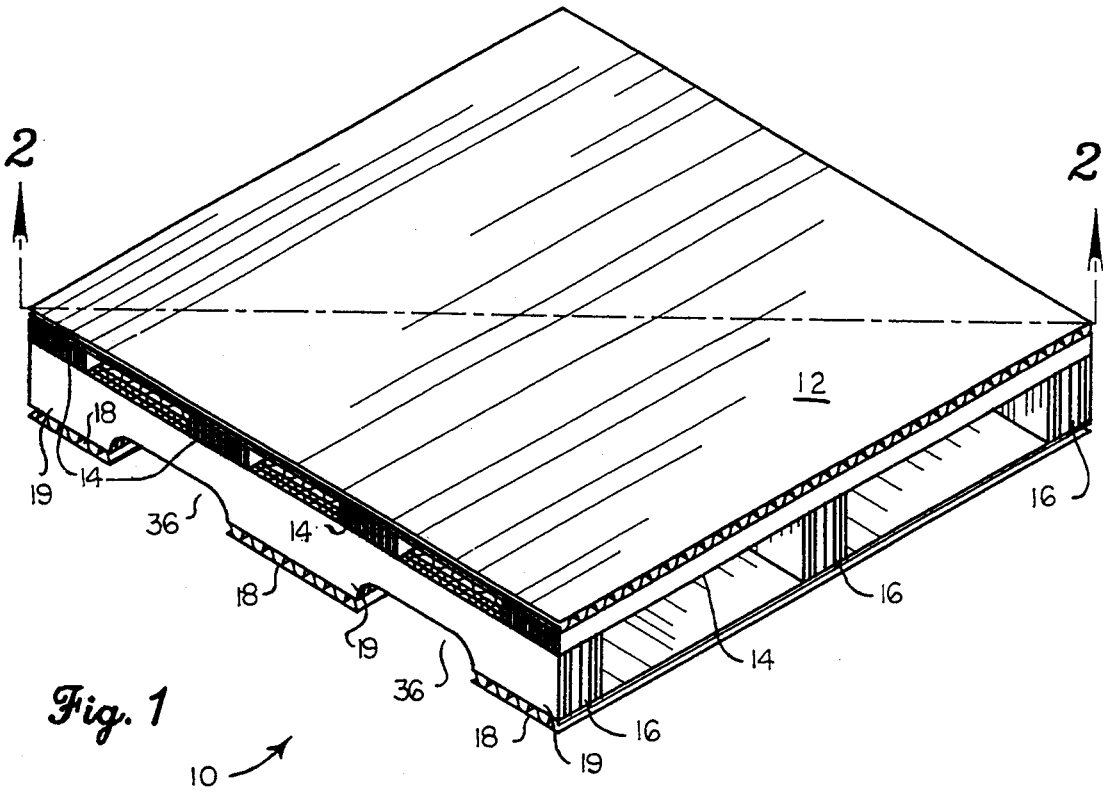
FIG. 1 is a perspective view of a pallet of the present invention, showing its general configuration and features.
Figure 2:
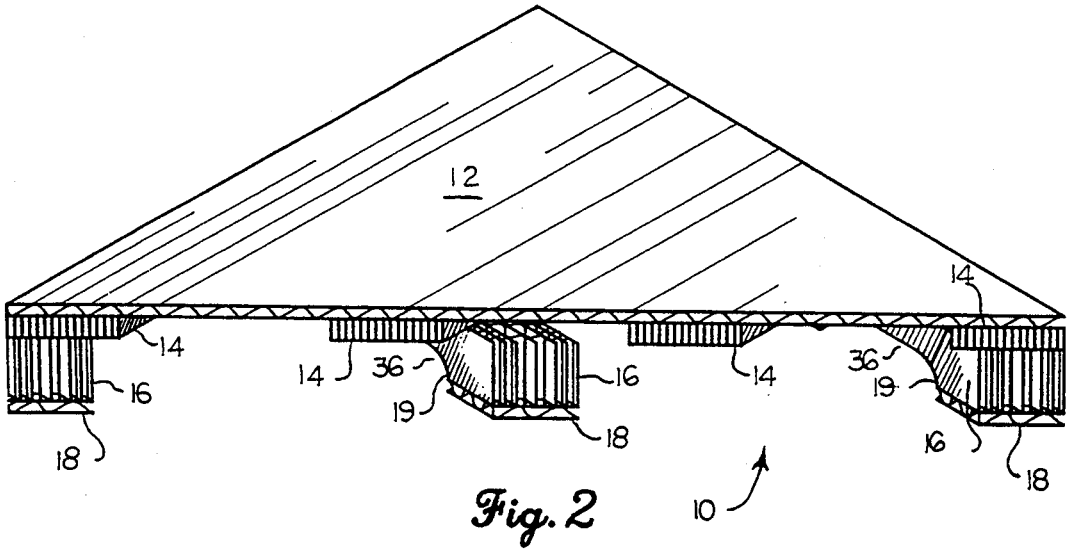
FIG. 2 is a perspective view in section of a pallet along line 2—2 of FIG. 1.

Referring now particularly to FIGS. 1 and 2 of the drawings, the present invention will be seen to relate to a pallet construction using laminated plural sheets of corrugated material. Pallet 10 is of a generally conventional configuration, having a top sheet 12, plural deck boards 14, plural stringers 16, and an (optional) bottom sheet(s) 18. However, each of the above components are formed of varying numbers of laminations of corrugated sheet material, adhesively secured together. In the pallet 10 of FIGS. 1 and 2, it will be seen that the top sheet 12 comprises a single corrugated sheet with its corrugations or flutes at right angles to the deck boards 14, in order to provide maximum strength. The deck boards 14 will also be seen to include multiple plies or layers of corrugated sheets. The stringers 16 are also formed of multiple plies, in this case a total of six vertical plies each. Finally, an optional bottom sheet(s) 18 of one or more plies may be applied to the bottoms of the stringers 16 if desired. The bottom sheets of FIGS. 1 and 2 comprise three individual sheets disposed across the pads or feet 19 of the stringers 16, with their corrugations running perpendicular to the stringers 16 for maximum strength. Alternatively, sheet 18 may be formed as a single, unitary sheet, if desired or required.

It will be understood that generally, the number of sheets used in the formation of the deck boards and stringers will be greater than shown in FIGS. 1 and 2, in order to provide greater strength. The relatively small number of plies shown in FIGS. 1 and 2 are to provide for drawing clarity. The precise number of corrugated sheets, and their orientation, may be adjusted according to the required strength and anticipated loads for an individual pallet. FIGS. 4A through 4D and 5A through 5C show greater numbers of plies or corrugated sheets, which may be more typical for pallets requiring relatively high strength.

Figure 3B:
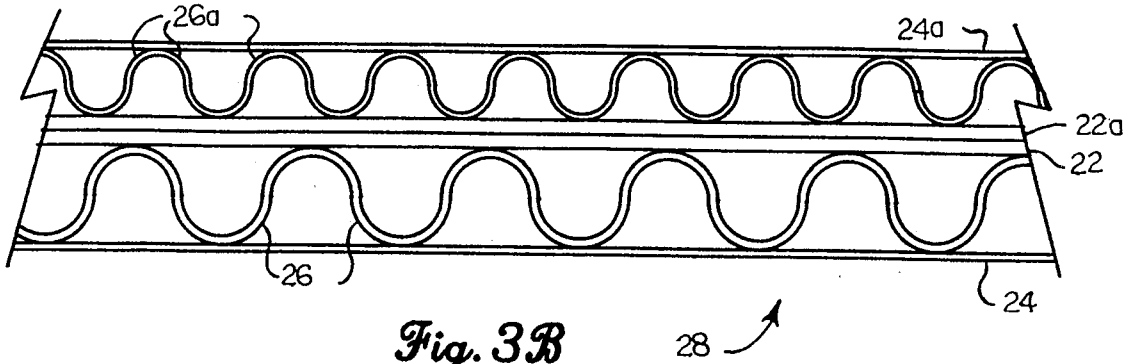
FIG. 3B is a side view in section of the corrugated sheets of FIG. 3A adhesively secured together to form a reverse lamination and substantially cancel the curvature or warping of the individual asymmetrical corrugated sheets.
Figure 3A:
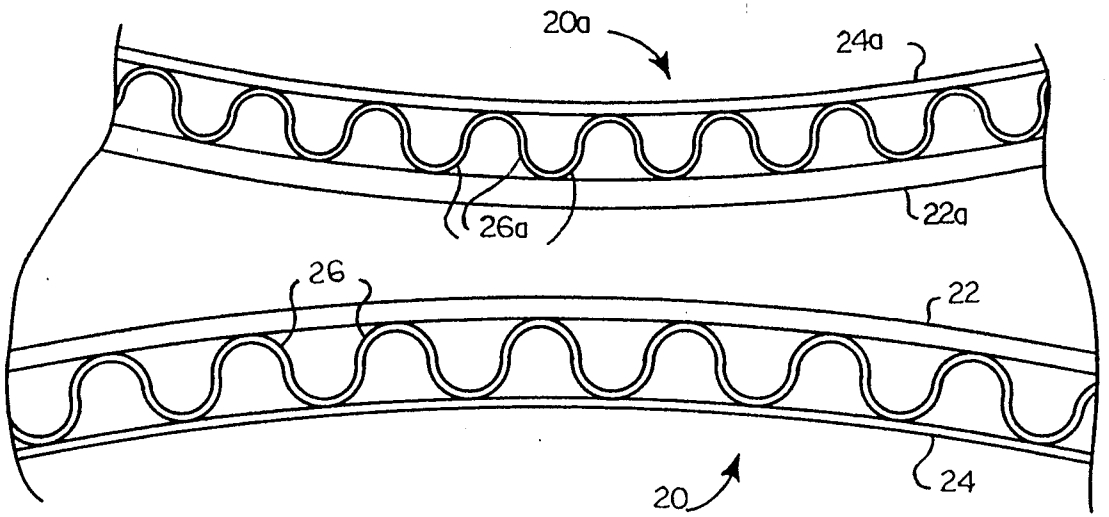
FIG. 3A is a side view in section of two mirrored asymmetrical corrugated sheets each having opposite walls of different weights or thicknesses, showing the warping or curvature inherent in such asymmetrical sheets.

One problem with the assembly of multiple plies of sheet material is that often the sheets each have different properties, and when assembled the different properties result in the warping or curvature of the completed lamination. This problem may occur due to the properties of otherwise flat and uniform sheets of material when they are laminated, but often is due to the sheets themselves being warped or curved prior to laminating into multiple sheets. Nevertheless, it may be desirable to utilize sheets having different properties, e.g., two or more corrugated sheets of different thicknesses, and/or unsymmetrical sheets having different wall thicknesses or weights on each side of the corrugated core, as shown in FIG. 3A. For example, it may be desirable to provide a relatively thick wall sheet along the outer surface to resist puncture to a greater degree, while providing lighter core sheets having greater spacing as a filler; other requirements might result in entirely different assemblies or configurations. The present invention includes means providing for the trueness or flatness of completed laminations using unsymmetrical sheets, as shown in FIGS. 3A and 3B.

FIG. 3A discloses a first corrugated sheet 20, comprising a first outer wall sheet 22 having a relatively heavy weight, an opposite second outer wall sheet 24 having a lighter weight than the first sheet 22, with the two wall sheets 22 and 24 separated by a corrugated core 26. The second corrugated sheet 20*a* is formed similarly, with a heavy first outer wall sheet 22*a*, a lighter second outer wall sheet 24*a*, and a corrugated core 26*a*. Due to the heavier first outer wall sheets 22 and 22*a* respectively of the two corrugated sheets 20 and 20*a*, it will be seen that the two corrugated sheets 20 and 20*a* have become warped.

When such warped sheets are laminated together with their curvatures and like sides facing the same direction, the warp or curvature will be "built in" to the resulting laminated plies. The resulting warped laminations are extremely difficult to work with, as it is nearly impossible to construct a pallet or other structure of laminated corrugated sheets, which is straight and true. Attempting to flatten or straighten such laminations after their formation can weaken the structure, thus removing much of the advantage of such multiple plies, and/or it can be difficult to form proper glue or adhesive joints between such warped components (e.g., between a base board having horizontally disposed laminate layers and an overlying top sheet), due to the difficulty in achieving complete contact between the two curved surfaces.

The present invention addresses this problem by assembling two such sheets with their like outer walls (e.g., 22 and 22*a*) facing one another, so the two corrugated sheets 20 and 20*a* are disposed in a "mirror image" to one another. Adhesive, glue, etc. is applied between the two sheets and pressure is applied (press, slacking, weights, etc.) during the adhesive curing process. The resulting reverse lamination 28, shown in FIG. 3B, causes any warping or curvature of the two individual corrugated sheets to be canceled, and a substantially flat reverse lamination results. The above process may be applied to any number of corrugated sheets to produce multiple laminations for any of the components used in the construction of the present shipping pallets. In addition, it will be seen that individual corrugated sheets 20 and 20*a* having differing corrugation thicknesses (e.g., a relatively thin sheet 20 and a relatively thick sheet 20*a*) may be used to form such reverse laminations, if desired, with much the same result.

Figure 4A:
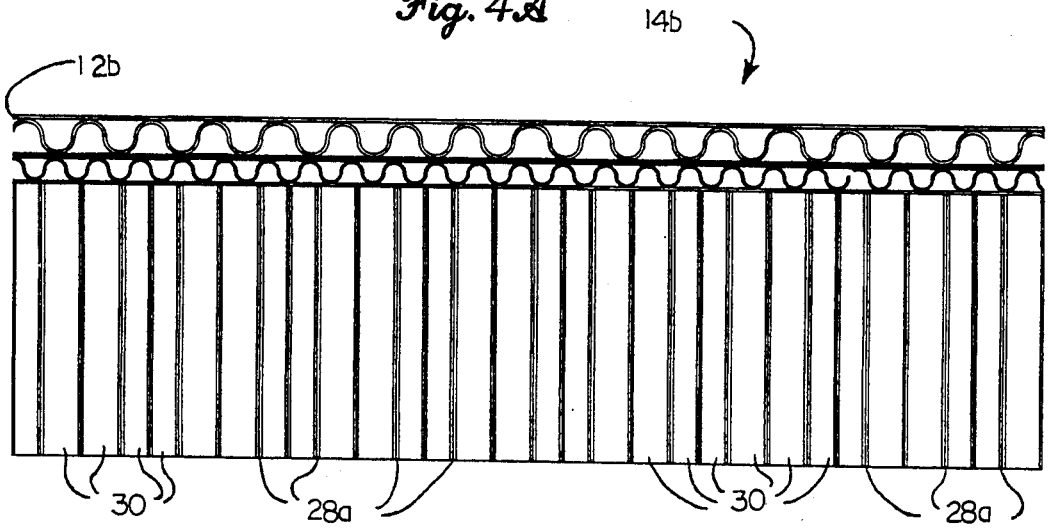
FIG. 4A is an end view of a deck board, showing a plurality of reverse laminations in a vertical array and a double ply corrugated top sheet.

The deck boards 14*b* through 14*e* respectively disclosed in FIGS. 4A through 4D, provide applications of the above reverse lamination technique. In FIG. 4A, a deck board 14*b* is formed of plural reverse laminations 28*a* of individual corrugated sheets of differing thicknesses, as shown substantially in FIG. 3B. However, the corrugated sheets and resulting laminations will be seen to be vertically oriented, with the individual corrugations or flutes 30 in a vertical array as in the deck board configuration of pallet 10 of FIGS. 1 and 2. Such an arrangement provides a deck board 14*b* (or other component using the same arrangement) of substantial strength in the vertical direction, due to the crush resistance of the individual corrugations 30 along their length.

Figure 4B:
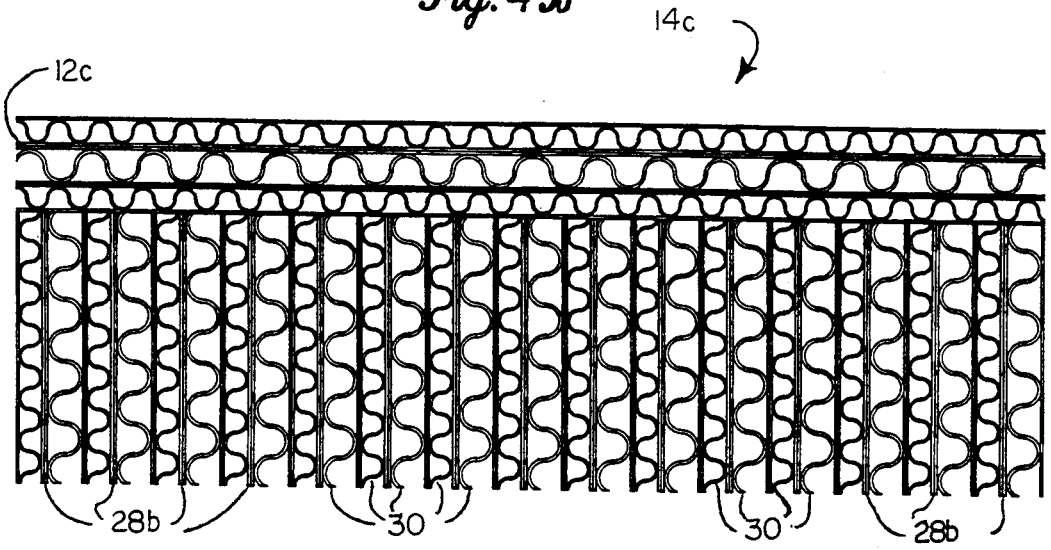
FIG. 4B is an end view of another embodiment of a deck board, showing a plurality of reverse laminations with the corrugations or flutes in a horizontal array and a triple ply corrugated top sheet.

Alternatively, it may be desirable to provide greater bending resistance by arranging the laminations 28*b* so that the individual corrugations are disposed horizontally, as shown in the deck board 14*c* of FIG. 4B. In the deck board 14*c*, the reversed lamination sheets 28*b* are still vertically disposed, but the ends of the individual corrugation flutes 30 may be seen in this end view; thus, the corrugations 30 are horizontal and run the length of the deck board 14*c*. While offering less vertical crush resistance, the vertically disposed walls of the corrugated sheets provide relatively good resistance to bending loads when such is desired.

Figure 4C:
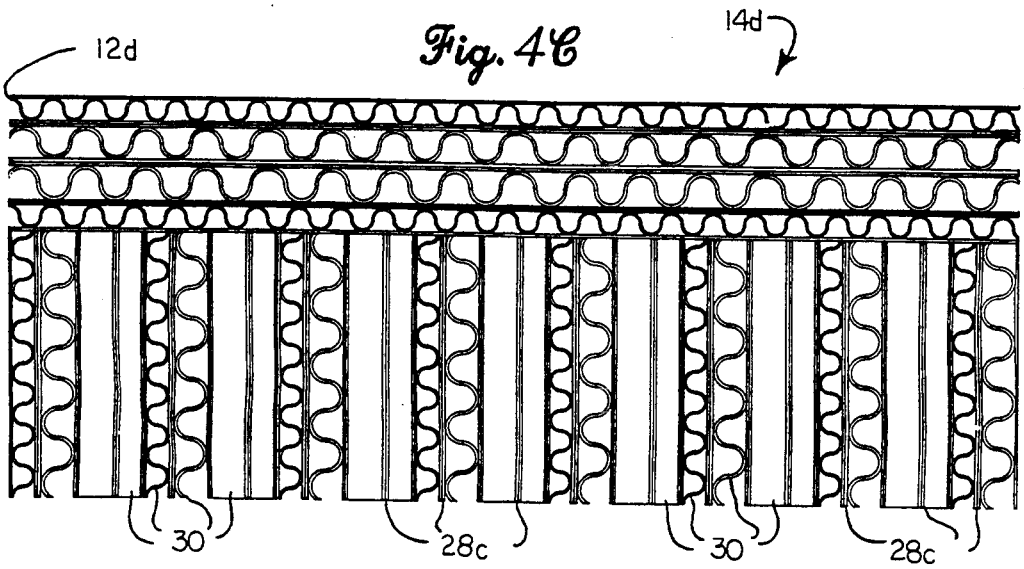
FIG. 4C is an end view of yet another embodiment of a deck board, showing a plurality of cross laminated sheets and a top sheet comprising two reverse laminations of four corrugated sheets.

FIG. 4C discloses a deck board 14*d* in which the reverse laminations 28*c* are also vertically disposed, but with alternating horizontally and vertically disposed corrugation flutes 30. The resulting cross corrugated reverse laminations 28*c* offer many of the same properties as plywood with its laminations oriented vertically. Much of the crush resistance of deck board 14*b*, in combination with the bending resistance of board 14*c*, is achieved with the cross corrugated laminations 28*c* of deck board 14*d*.

Figure 4D:
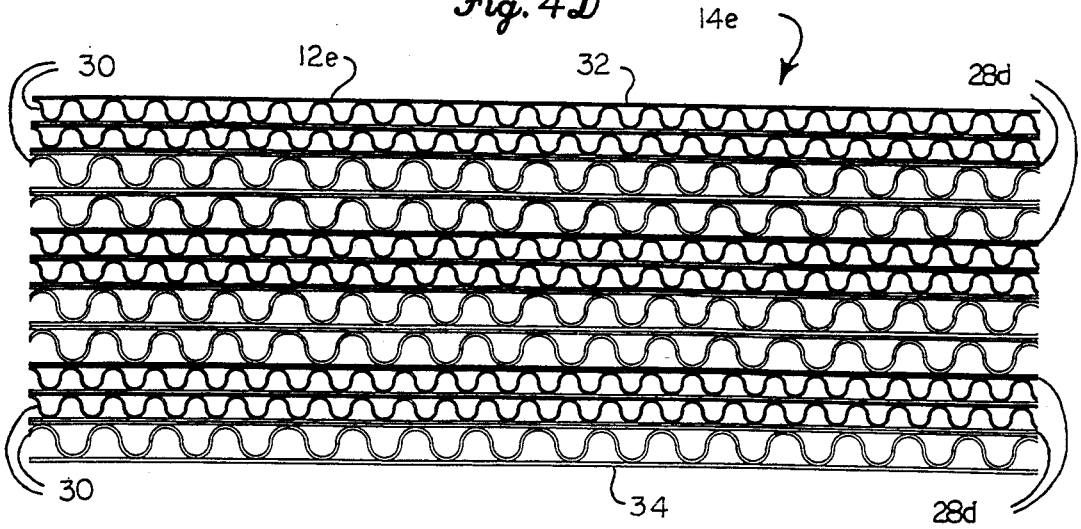
FIG. 4D is an end view of still another embodiment of a deck board, showing a plurality of reverse laminated corrugated sheets in a horizontal array, thus providing for minimal cutting of corrugations and material and thereby reducing dust during manufacture and use.

Yet another alternative is the deck board 14*e* of FIG. 4D. Deck board 14*e* has its individual reverse laminations 28*d* in a horizontal array, with the individual sheet walls disposed horizontally and the flutes 30 running the length of the deck board 14*e*. This configuration provides moderate bending strength due to the longitudinal arrangement of the individual corrugation flutes 30, but the outer walls of each of the corrugated sheets is horizontal, rather than vertical, thus limiting any bending resistance which might otherwise be provided, as in the case of the deck board 14*c* of FIG. 4B. However, this configuration does provide particular advantages in the reduction of dust residue from the manufacturing process. It will be seen that the deck boards 14 through 14*e* must each be cut from a sheet of multiple reverse laminations in order to arrive at boards having the desired width and length. By having the flutes 30 in a longitudinal array, the concentrated amount of material disposed across the corrugations and walls must only be cut across the relatively narrow end of the deck board 14*e*. While the end cut produces a relatively large amount of dust residue per unit of cut length, the total cut is relatively short, thus reducing the production of dust. The vertical side cut, while being relatively longer than the end cut, runs parallel to the corrugation flutes 30, thus reducing the amount of material to be cut. The portion of the board 14*e* having the greatest area, i.e., the upper and lower surfaces 32 and 34, require no cutting due to their finished surfaces provided by the relatively smooth outer walls of the top and bottom reverse laminations. The above dust reduction is of value in the use of a pallet constructed with such deck boards 14*e*, as relatively little dust is trapped within the corrugations to be dispersed later.

In each of the above deck boards 14*b* through 14*e*, a top sheet 12*b* through 12*e* is respectively provided. These top sheets will be seen to have differing configurations, in the manner of the various deck boards discussed above. The top sheet 12*b* of FIG. 14*b* will be seen to be a single reverse lamination of a single relatively thick and single relatively thin corrugated sheet. However, it may be desirable to provide a top sheet 12*c* having greater strength, as in the triple ply top sheet 12*c* of FIG. 4B. Even greater strength may be provided by a four ply top sheet 12*d* formed of two reverse laminations, as shown atop the deck board 14*d* of FIG. 4C. Finally, deck board 14*e* of FIG. 4D discloses a top sheet 12*e* comprising a single ply of corrugated sheet in the manner of the top sheet 12 of the pallet 10 of FIGS. 1 and 2, where relatively little strength is required of the top sheet 12*e*.

Figure 5A:
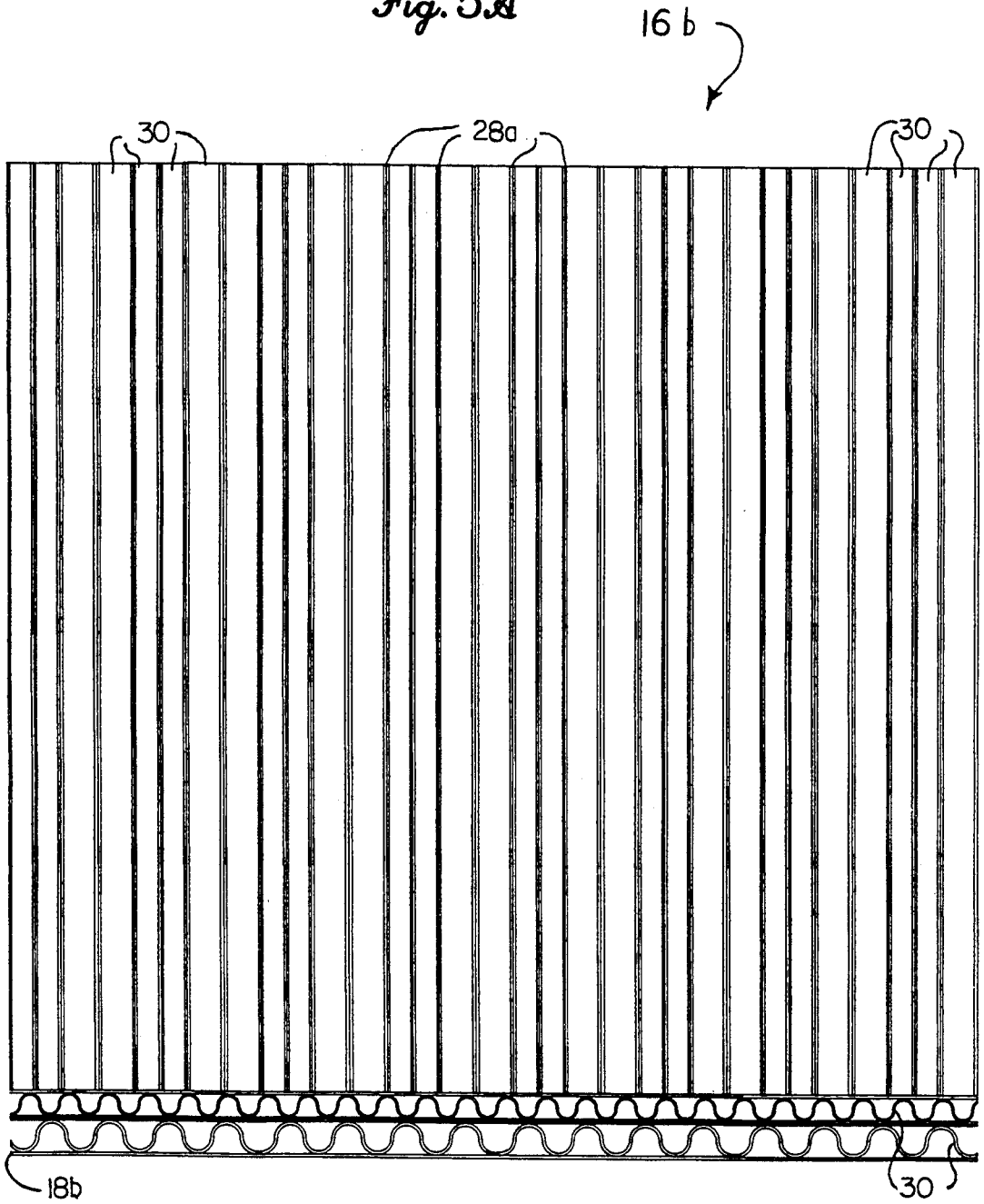
FIG. 5A is an end view of a stringer, comprising a plurality of vertical reverse laminations in the manner of the deck board of FIG. 4A, and a reverse laminated bottom sheet.
Figure 5B:
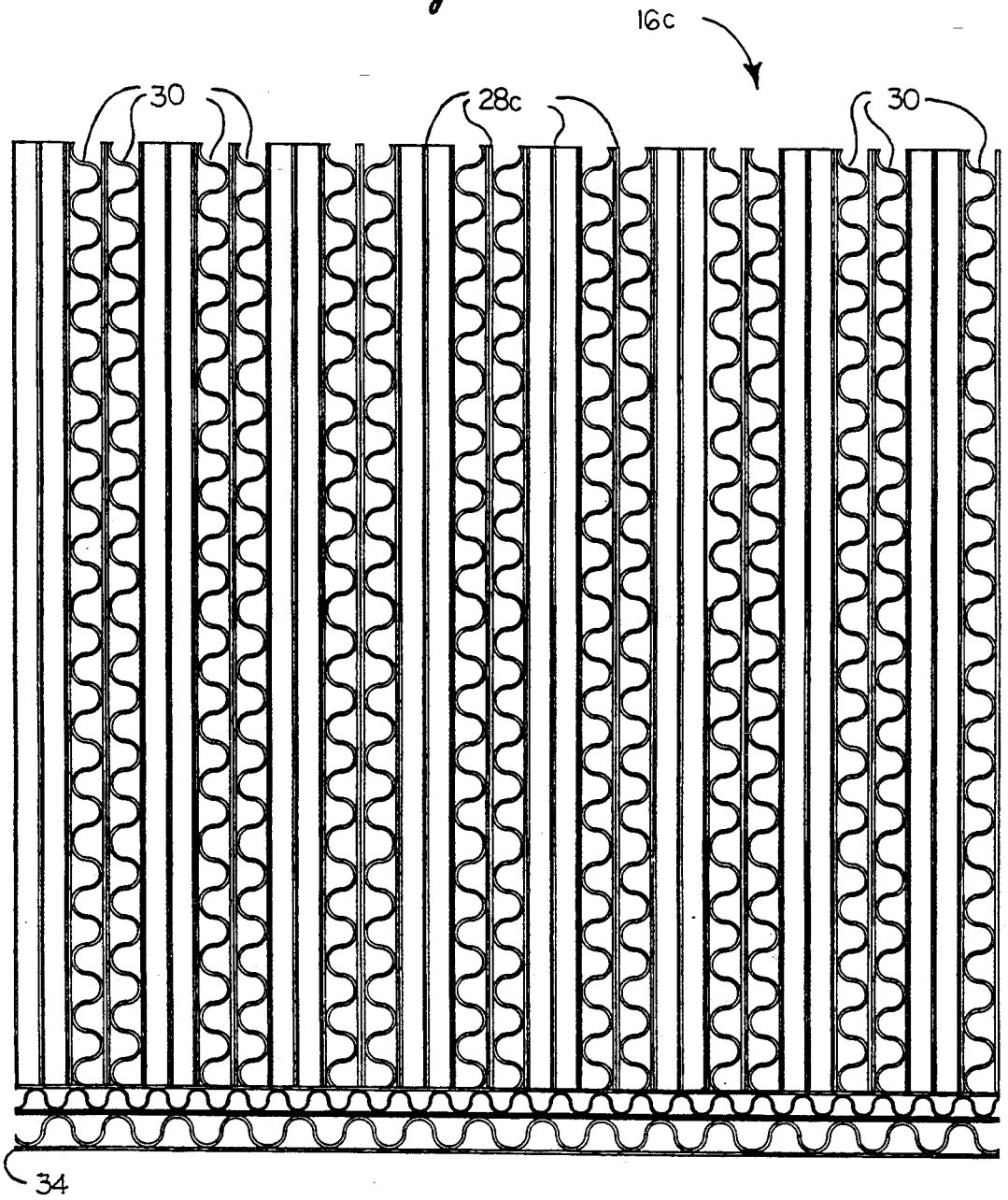
FIG. 5B is an end view of another embodiment of a stringer, comprising a plurality of cross laminated sheets using reverse laminations, in the manner of the deck board of FIG. 4C.
Figure 5E:
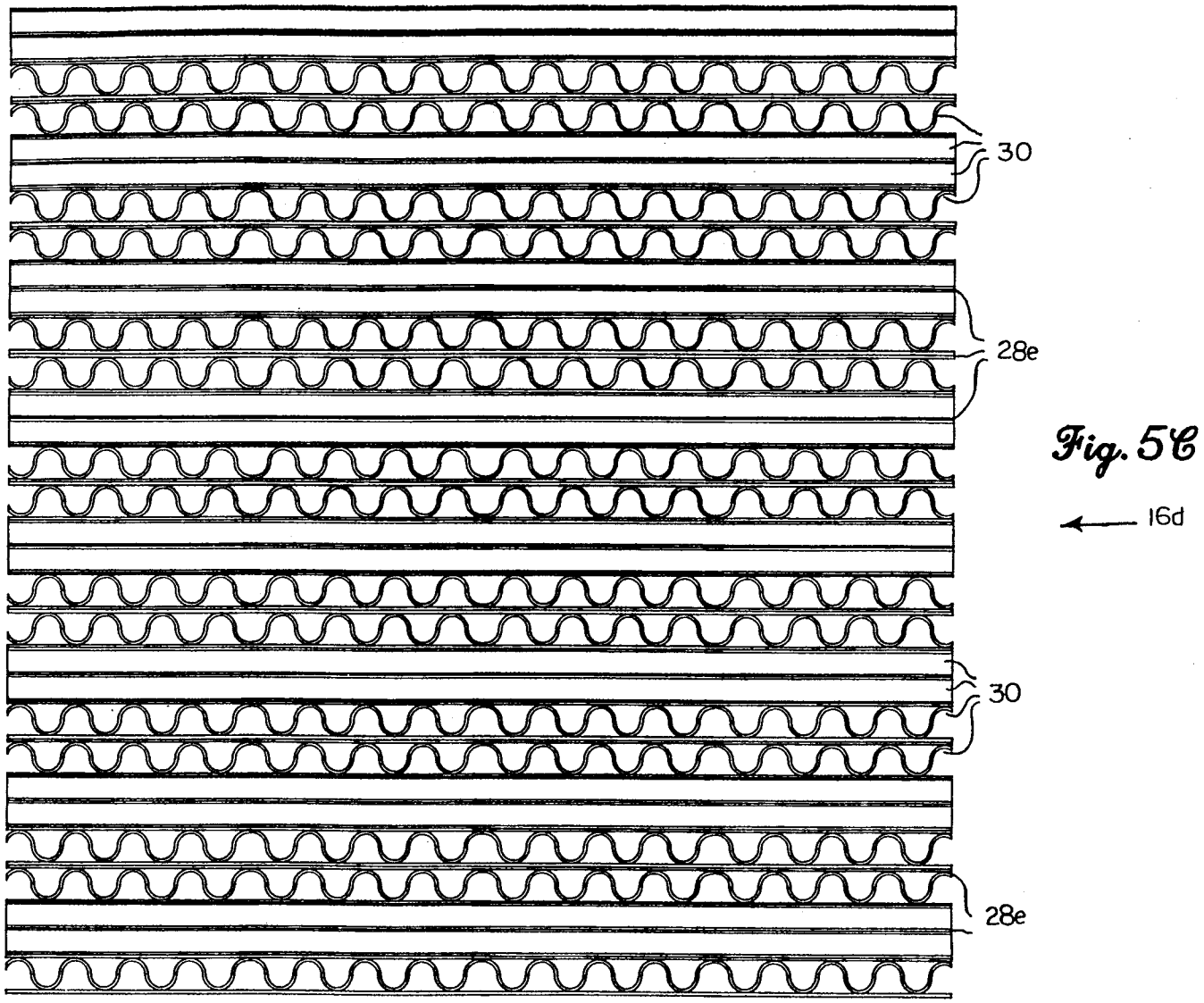
FIG. 5C is an end view of yet another embodiment of a stringer, comprising a plurality of reverse laminated sheets horizontally disposed in the manner of the dust free deck board of FIG. 4D.

FIGS. 5A through 5C provide end views respectively of various configurations of stringers 16*b* through 16*d*. In FIG. 5A, the stringer 16*b* is formed of plural reverse laminations 28*a* arrayed vertically, as in the vertical reverse laminations 28*a* of the deck board 14*b* of FIG. 4A and the pallet 10 of FIGS. 1 and 2. Similar advantages are provided by the similar arrangement. FIG. 5B discloses a stringer 16*c* comprising plural cross corrugated reverse laminations 28*c*, as in the deck board 14*d* of FIG. 4C. The stringer 16*d* of FIG. 5C will be seen to be similar to the configuration of the stringer 16*c* of FIG. 5B, but having the reverse laminations 28*e* turned 90 degrees so the walls of each of the corrugated sheets is horizontal. This horizontal cross corrugated reverse lamination 28*e* will be seen to be adaptable to any of the other structural members of the shipping pallets of the present invention, including top sheet 12, deck boards 14, and the optional bottom sheet 18. A bottom sheet 34 may be added optionally, as required or desired.

The above disclosure will be seen to provide shipping pallets 10, or of other configurations, formed of various configurations, arrangements and orientations of corrugated sheet material. The present shipping pallets are particularly adaptable to construction from corrugated fiberboard or paperboard, either of virgin fiber or recycled material. However, other materials may also be used, e.g., virgin or recycled corrugated plastic sheet. The present shipping pallets provide for ready disposal when they have deteriorated so they are no longer usable, as facilities exist virtually throughout the country at present for the recycling of such materials, unlike wood pallets.

The specific reverse lamination technique disclosed provides for the substantial elimination of warped sheets of materials and the accompanying problems incurred by such, including poor glue joints resulting from poor contact between adjacent sheets being glued, misalignment of components, etc. The reverse laminations may be assembled in virtually any orientation of corrugation plies, thus enabling the manufacturer to "tune" the strength of the present shipping pallet as required for a specific purpose; such is not possible with wood pallets, other than by adjusting the thickness of the wood. Moreover, the orientation of the corrugations of the various laminations of the present shipping pallet may be arranged to reduce substantially the amount of dust residue produced during cutting operations, as disclosed in the discussion of the deck board 14*e* of FIG. 4D above. This reduction in dust production carries over into the use of the pallet, as relatively little dust will be trapped within the flutes or corrugations to be released later during handling.

While the construction of the present pallets of multiple laminations of corrugated material provides numerous advantages, as discussed above, the general configuration of such pallets is preferably along the lines of earlier pallets of wood, known in the shipping industry. As such, no special handling or equipment modification is required. Standard fork lifts and other equipment can handle the present pallets with equal or greater facility as with earlier pallets, due to the relatively light weight of the present shipping pallets. The stringers may include lower cutouts or notches 36, as shown in FIGS. 1 and 2, providing for the insertion of the forks of a forklift therein, thus providing for lifting access from any of the four sides of the pallet. The bottom sheet may comprise a single, unitary, continuous sheet spanning the entire bottom of the pallet across the stringers, or alternatively may comprise a series of separate boards spanning the stringer pads or feet, as shown in FIGS. 1 and 2. Additional upper notches (not shown) may be provided for the placement of the deck boards 14 therein. Alternatively, the deck boards may be adhesively secured directly to the top of the stringers, as shown in FIGS. 1 and 2, if desired.

The present shipping pallets thus require little in the way of costly tools and equipment to manufacture, other than means for applying pressure during the adhesive lamination of the individual corrugated sheets and saws or other cutting tools to shape the resulting laminations as required to form the various pallet components. No complex folding machines or other devices for applying mechanical fasteners or other devices are required. The result is an exceptionally cost effective shipping pallet, providing numerous advantages in shipping costs due to its light weight, low cost of manufacture, and ease of recycling.

It is to be understood that the present invention is not limited to the sole embodiments described above, but encompasses any and all embodiments within the scope of the following claims.

I claim:

1. A shipping pallet constructed of multiple laminates of corrugated sheets and formed of components comprising:

a plurality of spaced apart elongate stringers, with a plurality of spaced apart elongate deck boards adhesively secured perpendicularly across and atop said stringers, and a top sheet adhesively secured atop said deck boards, with said top sheet having opposite first and third edges disposed parallel to said elongate stringers and opposite second and fourth edges disposed parallel to said elongate deck boards;

said top sheet comprising at least one of said corrugated sheets, and;

said stringers and said deck boards each being constructed of plural reverse laminations of said corrugated sheets, said corrugated sheets each having a first wall, a second wall, and a plurality of corrugation flutes disposed therebetween, with said first wall of one of said corrugated sheets being adhesively attached to said first wall of another of said corrugated sheets to provide a reverse lamination, whereby;

at least said stringers and said deck boards of said pallet are substantially free from warps or curvature by means of said reverse lamination of said corrugated sheets used in the construction of said pallet, and;

said first wall of each of said corrugated sheets is of a heavier weight than said second wall.

2. The shipping pallet of claim 1 including:

at least one bottom sheet adhesively secured beneath said stringers.

3. The shipping pallet of claim 1 wherein:

one of said corrugated sheets comprising said reverse lamination is thicker than another of said corrugated sheets.

4. The shipping pallet of claim 1 wherein:

said corrugated sheets are formed of fiber material.

5. The shipping pallet of claim 1 wherein:

said corrugated sheets are formed of plastic.

6. The shipping pallet of claim 1 wherein:

at least one of said components of said pallet is formed with said corrugation flutes disposed perpendicular to said top sheet.

7. The shipping pallet of claim 1 wherein:

at least one of said components of said pallet is formed with said corrugation flutes disposed substantially parallel to said first and third edges of said top sheet.

8. The shipping pallet of claim 1 wherein:

at least one of said components of said pallet is formed with said corrugation flutes disposed substantially parallel to said second and fourth edges of said top sheet.

9. The shipping pallet of claim 1 wherein:

at least one of said components of said pallet is formed with said corrugation flutes of at least one of said reverse laminations being perpendicular to said corrugation flutes of another of said reverse laminations.

10. A shipping pallet constructed of multiple laminates of corrugated sheets and formed of components comprising:

a plurality of spaced apart elongate stringers, with a plurality of spaced apart elongate deck boards adhesively secured perpendicularly across and atop said stringers, and a top sheet adhesively secured atop said deck boards, with said top sheet having opposite first and third edges disposed parallel to said elongate stringers and opposite second and fourth edges disposed parallel to said elongate deck boards;

said top sheet comprising at least one of said corrugated sheets;

said stringers and said deck boards each being constructed of plural laminations of said corrugated sheets, said corrugated sheets each having a first wall, a second wall, and a plurality of corrugation flutes disposed therebetween, with at least said stringers and said deck boards each having a substantially rectangular cross section with opposed top and bottom surfaces, opposed first and second sides, and opposite ends, with said opposite ends having a smaller area than said first and second sides and said first and second sides having a smaller area than said top and bottom surfaces; and at least said deck boards comprising a plurality of said sheets having said corrugation flutes disposed substantially parallel to said elongate deck boards, with each said first and second wall disposed parallel to said top sheet to provide a smooth and unbroken said top and bottom surfaces of said deck boards, whereby;

dust production during the manufacture of said deck boards is minimized due to the minimal cross sectional area of said corrugation flutes exposed at said deck board opposite ends and lateral area of said corrugation flutes exposed along said deck board first and second sides.

11. The shipping pallet of claim 10 including:

at least one bottom sheet adhesively secured beneath said stringers.

12. The shipping pallet of claim 10 wherein:

said first wall of each of said corrugated sheets is of a heavier weight than said second wall.

13. The shipping pallet of claim 10 wherein:

one of said corrugated sheets comprising said reverse lamination is thicker than another of said corrugated sheets.

14. The shipping pallet of claim 10 wherein:

said corrugated sheets are formed of fiber material.

15. The shipping pallet of claim 10 wherein:

said corrugated sheets are formed of plastic.

16. The shipping pallet of claim 10 wherein:

at least one of said components of said pallet is formed with said corrugation flutes disposed perpendicular to said top sheet.

17. The shipping pallet of claim 10 wherein:

at least one of said components of said pallet is formed with said corrugation flutes disposed substantially parallel to said first and third edges of said top sheet.

18. The shipping pallet of claim 10 wherein:

at least one of said components of said pallet is formed with said corrugation flutes disposed substantially parallel to said second and fourth edges of said top sheet.

19. The shipping pallet of claim 10 wherein:

at least one of said components of said pallet is formed with said corrugation flutes of at least one of said laminations being perpendicular to said corrugation flutes of another of said laminations.

* * * * *